US008866076B2

(12) United States Patent
Krutchinsky et al.

(10) Patent No.: US 8,866,076 B2
(45) Date of Patent: Oct. 21, 2014

(54) MULTI-POLE ION TRAP FOR MASS SPECTROMETRY

(71) Applicant: The Rockefeller University, New York, NY (US)

(72) Inventors: Andrew N. Krutchinsky, New York, NY (US); Vadim Sherman, Brooklyn, NY (US); Herbert Cohen, New York, NY (US); Brian T. Chait, New York, NY (US)

(73) Assignee: The Rockefeller University, New York, NY (US)

( * ) Notice: Subject to any disclaimer, the term of this patent is extended or adjusted under 35 U.S.C. 154(b) by 0 days.

(21) Appl. No.: 14/136,132

(22) Filed: Dec. 20, 2013

(65) Prior Publication Data

US 2014/0246582 A1 Sep. 4, 2014

Related U.S. Application Data

(63) Continuation of application No. 13/782,708, filed on Mar. 1, 2013, now Pat. No. 8,637,817.

(51) Int. Cl.

| | |
|---|---|
| ***H01J 49/00*** | (2006.01) |
| ***H01J 49/02*** | (2006.01) |
| ***H01J 49/36*** | (2006.01) |

(52) U.S. Cl.

CPC *H01J 49/36* (2013.01); *H01J 49/02* (2013.01)
USPC ..... 250/293; 250/281; 250/282; 250/283; 250/290

(58) Field of Classification Search

USPC ..... 250/281, 282, 283, 290, 292, 293
See application file for complete search history.

(56) References Cited

U.S. PATENT DOCUMENTS

| | | | | |
|---|---|---|---|---|
| 5,420,425 | A | 5/1995 | Bier et al. | |
| 5,572,035 | A | 11/1996 | Franzen | |
| 6,838,666 | B2 * | 1/2005 | Ouyang et al. | 250/292 |
| 7,323,683 | B2 | 1/2008 | Krutchinsky et al. | |
| 7,358,488 | B2 | 4/2008 | Chernushevich et al. | |
| 7,365,317 | B2 | 4/2008 | Whitehouse et al. | |
| 8,637,817 | B1 * | 1/2014 | Krutchinsky et al. | 250/293 |
| 2010/0276591 | A1 | 11/2010 | Finlay | |

* cited by examiner

*Primary Examiner* — Michael Maskell
(74) *Attorney, Agent, or Firm* — Hoffmann & Baron, LLP

(57) ABSTRACT

An ion trap includes a containment region for containing ions, and a plurality of electrodes positioned on a regular polyhedral structure encompassing the containment region. An electrode is positioned on each vertex of the encompassing structure and at least one of the polygonal surfaces includes additional electrodes configured to form a plurality of quadrupoles on the surface. Alternating RF voltage is applied to the plurality of electrodes, so that directly neighboring electrodes are of equal amplitude and opposite polarity at any point in time. This configuration on the polyhedral structure forms a potential barrier for repelling the ions from each of the regular polygonal surfaces and containing them in the trap. Mass selective filters can be formed from the quadrupoles for parallel mass analysis in different m/z windows. Application of a small DC potential to a plate electrode outside the quadrupoles preferentially depletes single charged ions for enhanced signal-to-noise analysis.

17 Claims, 9 Drawing Sheets

MULTI-POLE ION TRAP FOR MASS SPECTROMETRY

CROSS-REFERENCE TO RELATED APPLICATIONS

This application is a continuation of co-pending U.S. patent application Ser. No. 13/782,708, filed on Mar. 1, 2013, the entirety of which is incorporated herein by reference.

GOVERNMENTAL SUPPORT

The research leading to the present invention was supported, at least in part, by NIH Grant Nos. RR00862 and GM103314. Accordingly, the United States Government may have certain rights in the invention.

TECHNICAL FIELD

The present disclosure relates to ion traps and, in particular, to a multi-pole ion trap device for efficient and high capacity storage of ions and parallel mass selective ion ejection.

BACKGROUND

Ion trap mass spectrometers have conventionally operated with a three-dimensional (3D) quadrupole field formed, for example, using a ring electrode and two end caps. In this configuration, the minimum of the potential energy well created by the radio-frequency (RF) field distribution is positioned in the center of the ring. Because the kinetic energy of ions injected into an ion trap decreases in collisions with buffer gas molecules, usually helium, the injected ions naturally localize at the minimum of the potential well. As has been shown using laser tomography imaging, the ions in these conventionally constructed ion traps congregate in a substantially spherical distribution, which is typically smaller than about 1 millimeter in diameter. The result is a degradation of performance of the device when attempting to trap large numbers of ions, due to space charge effects.

As one possible solution to this problem, quadrupole mass spectrometers having a two-dimensional quadrupole electric field were introduced in order to expand the ion storage area from a small sphere into an extended cylindrical column. An example of this type of spectrometer is provided in U.S. Pat. No. 5,420,425 to Bier, et al. The Bier, et al. patent discloses a substantially quadrupole ion trap mass spectrometer with an enlarged or elongated ion occupied volume. The ion trap has a space charge limit that is proportional to the length of the device. After collision relaxation, ions occupy an extended region coinciding with the axis of the device. The Bier, et al. patent discloses a two-dimensional ion trap, which can be straight, or of a circular or curved shape, and also an ellipsoidal three-dimensional ion trap with increased ion trapping capacity. Ions are mass-selectively ejected from the ion trap through an elongated aperture corresponding to the elongated storage area.

Though increased ion storage volume is provided by the ion trap geometry of the Bier, et al. patent, the efficiency and versatility of the mass spectrometer suffer, for example, due to the elongated slit and subsequent focusing of the ions required after ejection. In addition, the storage volume is limited by practical considerations, since the length of the spectrometer must be increased in order to increase the ion storage volume.

Space charge effects can also degrade the performance of many mass spectrometers if too many ions are accepted at once for analysis. One solution that has been proposed with limited success is to split the ion current into N independent m/z channels.

There is a need, therefore, to provide an efficient and versatile ion trap, particularly for use in a mass spectrometer, which provides both good ion storage volume and efficient ejection of selected ions.

SUMMARY

Features of the disclosure will become apparent from the following detailed description considered in conjunction with the accompanying drawings. It is to be understood, however, that the drawings are designed as an illustration only and not as a definition of the limits of this disclosure.

The disclosure is directed to a high-capacity and versatile ion trap device. In one aspect, the ion trap device includes a containment region for containing ions, and a regular polyhedral structure including a plurality of electrodes encompassing the containment region, wherein the containment region for containing ions corresponds substantially to a volume encompassed by the regular polyhedral structure. The ion trap further includes a plurality of vertices, and a plurality of regular polygonal surfaces which define the regular polyhedral structure. The plurality of electrodes includes a vertex electrode positioned on each vertex of the plurality of vertices, at least four of the vertex electrodes being positioned on a first surface of the plurality of regular polygonal surfaces. The plurality of electrodes preferably also includes additional electrodes on the first surface, which are configured to form a plurality of quadrupoles on the first surface. A first RF voltage is applied to alternating electrodes of the plurality of electrodes, and a second RF voltage is applied to electrodes interspersed between the alternating electrodes, the first and second RF voltage being of equal amplitude and opposite polarity at a point in time, so that directly neighboring electrodes of the plurality of electrodes are maintained at opposite phases. This configuration of the plurality of electrodes with alternating RF phase forms a potential barrier for repelling the ions in the containment region from each of the regular polygonal surfaces forming the regular polyhedral structure.

The disclosure is also directed to an efficient parallel mass spectrometer including an ion trap device formed in accordance with the disclosure. In one aspect, the parallel mass spectrometer includes: an ion source generating ions, a plurality of mass analyzers, and an ion trap device coupled to receive ions exiting the ion source and to eject ions to the plurality of mass analyzers in a mass-charge dependent manner. The ion trap further includes a containment region for containing the ions received from the ion source and a regular polyhedral structure including a plurality of electrodes encompassing the containment region, wherein the containment region for containing the ions corresponds substantially to a volume encompassed by the regular polyhedral structure. A plurality of vertices and a plurality of regular polygonal surfaces defines the regular polyhedral structure. The plurality of electrodes includes a vertex electrode positioned on each vertex of the plurality of vertices, at least four of the vertex electrodes being positioned on a first surface of the plurality of regular polygonal surfaces. The plurality of electrodes preferably also includes a set of electrodes configured to form a plurality of quadrupoles on the first surface. A first RF voltage is applied to alternating electrodes of the plurality of electrodes, and a second RF voltage is applied to electrodes interspersed between the alternating electrodes, the first and second RF voltage being of equal amplitude and opposite polarity at a point in time, neighboring electrodes of the plurality of electrodes being maintained at opposite phases. The plurality of electrodes with alternating RF phase are configured to form a potential barrier for repelling the ions from each of the plurality of regular polygonal surfaces forming the regular polyhedral structure.

Preferably each of the plurality of quadrupoles on the first surface is configured as a mass filter for selective ejection of the ions from the containment region in a predetermined ion mass-to-charge window. A frequency of the first RF and the second RF voltage applied to the electrodes in each of the plurality of quadrupoles corresponds to a characteristic frequency associated with the predetermined ion mass-to-charge window. Each of the plurality of quadrupoles is preferably coupled to a different one of the plurality of mass analyzers for parallel analysis.

The disclosure is also directed to an ion trap device including a containment region for containing ions; a regular polyhedral structure comprising a plurality of electrodes encompassing the containment region, wherein the containment region corresponds substantially to a volume encompassed by the regular polyhedral structure; a plurality of vertices and a plurality of regular polygonal surfaces and edges defining the regular polyhedral structure; the plurality of electrodes including an edge electrode positioned along each edge of the plurality of regular polygonal structures, and at least one additional electrode positioned on each of the plurality of regular polygonal surfaces; and a first RF voltage applied to each of the edge electrodes, and a second RF voltage applied to each of the at least one additional electrodes, the first and second RF voltage being of equal amplitude and opposite polarity at a point in time, the at least one additional electrode and the edge electrode associated with each surface being adjacent electrodes, the adjacent electrodes being maintained at opposite phases, wherein the plurality of electrodes are configured to form a potential barrier for containing the ions in the regular polyhedral structure.

In various additional aspects, each of the plurality of electrodes in an ion trap of the present disclosure can be one of a cylindrical rod or a sphere.

In still other aspects, electrodes can be edge electrodes that follow the outline or edges of the polygonal surfaces associated with the polyhedral structure.

In some aspects, the electrodes of alternating phase can be in the form of nested annuli structures, which can be, for example, triangular, rhombic, square, hex or any other shape corresponding to the shape of a face of a polyhedron.

In still other aspects, edge electrodes can alternate in phase with additional electrodes positioned on the surfaces, or faces of the regular polyhedral structure. In some aspects, the additional electrodes can be a single electrode, which can be a sphere, centered on each face of the regular polyhedral structure.

In other aspects, the regular polyhedral structure of the ion trap can be in the shape of a cube, tetrahedron, octahedron, icosahedron, or dodecahedron.

In one aspect, the structure of an ion trap device of the present disclosure is a cube, and includes a total of $N^3-(N-2)^3$ electrodes and $N^3-(N-2)^3-2$ quadrupoles, wherein N represents an integer preferably greater than 2.

In an additional aspect, a volume of the containment region of a cubic ion trap device of the present disclosure is about 10 cm×10 cm×10 cm, the ion trap device having an ion capacity of greater than $10^{10}$ ions.

In various other aspects, the ion trap device of the present disclosure can be configured as a collision cell, an ion-ion reactor, a molecule-ion reactor, or a photon-ion reactor.

In yet additional aspects, a plate electrode is positioned outside each of the surfaces of the regular polyhedral structure, and a first DC voltage sufficient to prevent depletion of ions from the containment region is applied at least to a first plate electrode. In still other aspects, a second DC stopping voltage that is lower than the first DC stopping voltage is applied to a second plate electrode positioned outside another one of the surfaces, the second DC stopping voltage generating a potential barrier sufficiently high to prevent depletion of multiple charged ions and sufficiently low to deplete singly charged ions from the containment region. Preferably, the second plate electrode is positioned outside one of the surfaces of the regular polyhedral structure which includes a plurality of quadrupoles. The depletion of the singly charged ions is preferably amplified by providing multiple channels, or axes, associated with the plurality of quadrupoles, for the depletion of the singly charged ions from the containment region.

DETAILED DESCRIPTION OF EMBODIMENTS

The following sections describe embodiments of the present disclosure. It should be apparent to those skilled in the art that the described embodiments with accompanying figures provided herein are illustrative only of the invention and not limiting, having been presented by way of example only.

An ion trap device of the present disclosure is a multi-pole ion trap, which includes a plurality of electrodes positioned around an ion confinement region, preferably in a regular pattern. The plurality of electrodes are preferably confined to the surface area, or faces, of a regular polyhedron and are positioned on at least the vertices of the regular polyhedral structure. In various preferred embodiments, the plurality of electrodes also includes additional electrodes arranged along the edges and between the edges in a regular pattern on the surfaces or faces of the polyhedron. By appropriate application of RF voltages, where neighboring electrodes are maintained at any point in time at opposing polarities or phases, these arrangements of electrodes on a polyhedral structure provide surfaces with a high electric potential, which will repel and contain ions within an ion containment region bounded by the polyhedral structure. Accordingly, the containment volume for storage of ions corresponds substantially to the volume encompassed by the surface area of the polyhedron.

The ion traps of the present disclosure can, therefore, offer very high ion capacity, not offered by conventional quadrupole systems. For example, an ion trap in the form of a cube of dimensions 10 cm×10 cm×10 cm, an example of which is provided in FIG. 1A, can store over $10^{10}$ ions according to simulations performed by the present inventors, and is limited in principle only by dimensions of the ion trap. This number is at least 1000 times higher than the capacity of the ion trap described, for example, in co-owned U.S. Pat. No. 7,323,683 to Krutchinsky, et al. (hereinafter "Krutchinsky"), the disclosure of which is incorporated herein by reference, and $10^5$-$10^6$ times higher than that of current commercial linear ion traps commonly used as mass analyzers for analyzing molecules (excluding large storage ring accelerators used in nuclear physics).

Figure 1A:
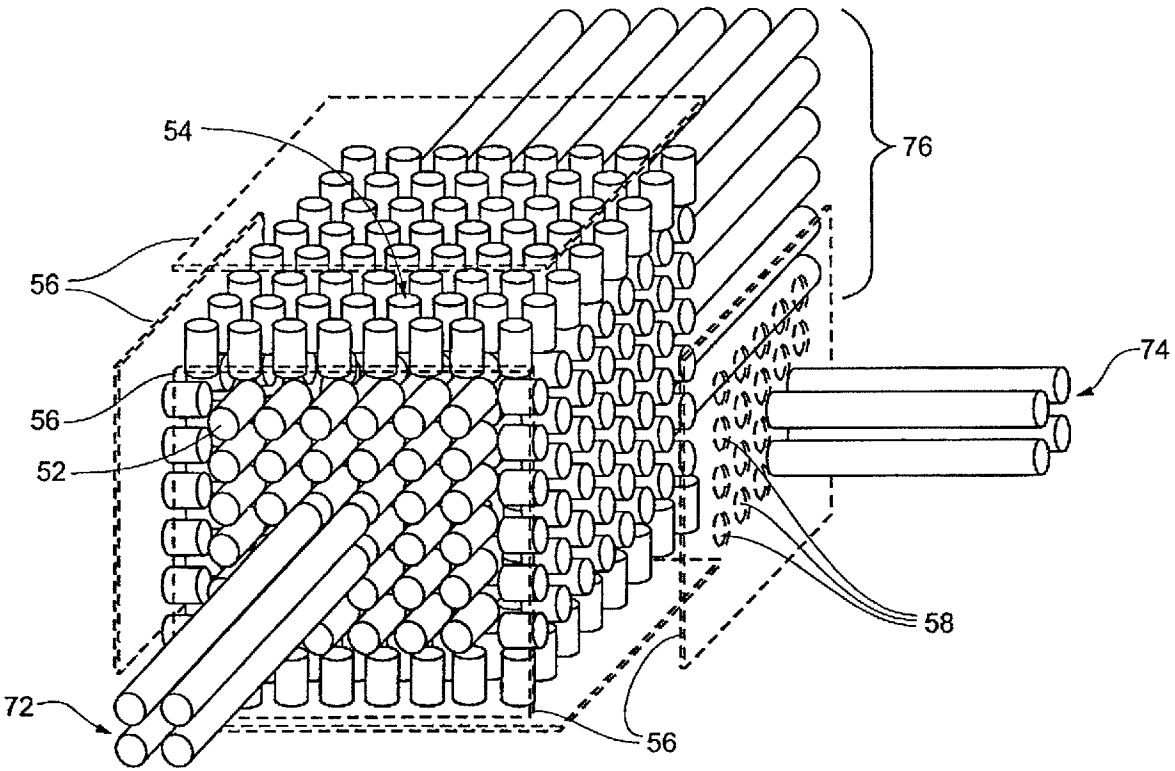
FIG. 1A is a schematic representation of a perspective view of an embodiment of an ion trap device of the present disclosure.

Referring to FIG. 1A, in one embodiment 50 of an ion trap device, a regular polyhedral structure in the form of a cube encloses an ion containment region 54. A plurality of electrodes 52, which are in the shape of cylindrical rods, are positioned on a surface area of the cube in a regular pattern, the cylindrical electrodes 52 being positioned at the eight vertices of the cube and also between the vertices in each dimension such that there are N×N electrodes positioned on each surface. In the example shown in FIG. 1A, the number of electrodes N equals 8.

The electrodes of the ion trap device are confined to the surfaces of the cube in FIG. 1A, providing a large hollow interior 54 for containing ions. In various additional embodiments of an ion trap device of the present disclosure in the shape of a cube, a total number of electrodes encompassing the ion containment region can be calculated as $N^3-(N-2)^3$ electrodes, where N is any integer number that is larger or equal to 2. In addition, preferably, the ends of the cylindrical electrodes in the embodiment of FIG. 1A are appropriately arranged and oriented to create a total of $N^3-(N-2)^3-2$ quadrupoles, from four closest neighbor electrode sets, on the surfaces of the cube. Accordingly, the ion trap of FIG. 1A, where N equals 8, is formed from 296 electrodes, from which 294 quadrupoles can be formed.

In preferred embodiments, N is greater than 2.

Figure 1B:
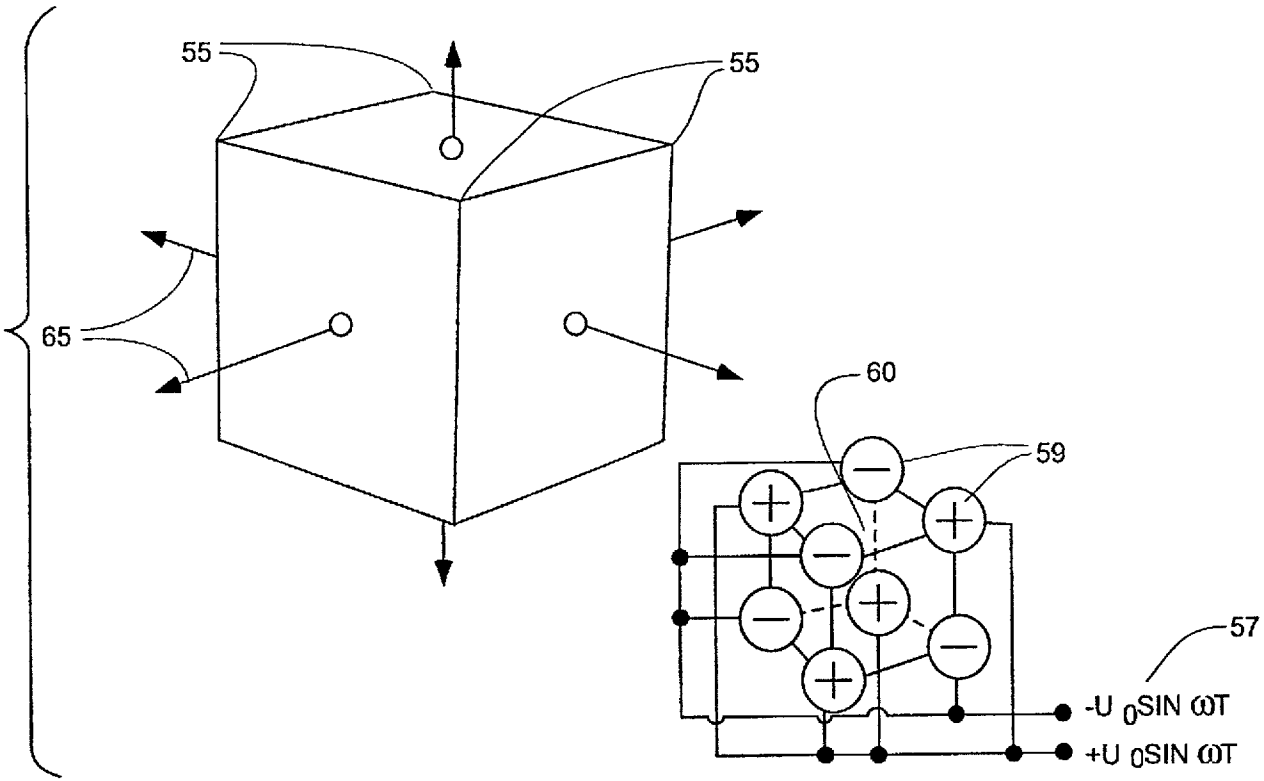
FIG. 1B is a schematic representation of a perspective view of another embodiment of an ion trap device of the present disclosure.

Quadrupoles are commonly known for use as ion guides and/or mass filters. Each pair of adjacent rods in a quadrupole is connected to a positive or a negative RF potential of suitable magnitude and frequency for the particular application, so that direct neighbors are maintained at opposing polarities or phases with the same amplitude. This arrangement is known to provide radial confinement of ions around a central axis of the rod set forming the quadrupole. Referring to FIG. 1B, for example, if an electrode is provided only at each of the eight vertices 55 of a cube surrounding an ion containment region 60, and opposing RF polarities 57 are applied to adjacent electrodes 59, six quadrupoles, one on each surface of the cube are formed, with the center of each square surface providing an axis 65 of the quadrupole around which ions can be substantially confined.

Figure 2:
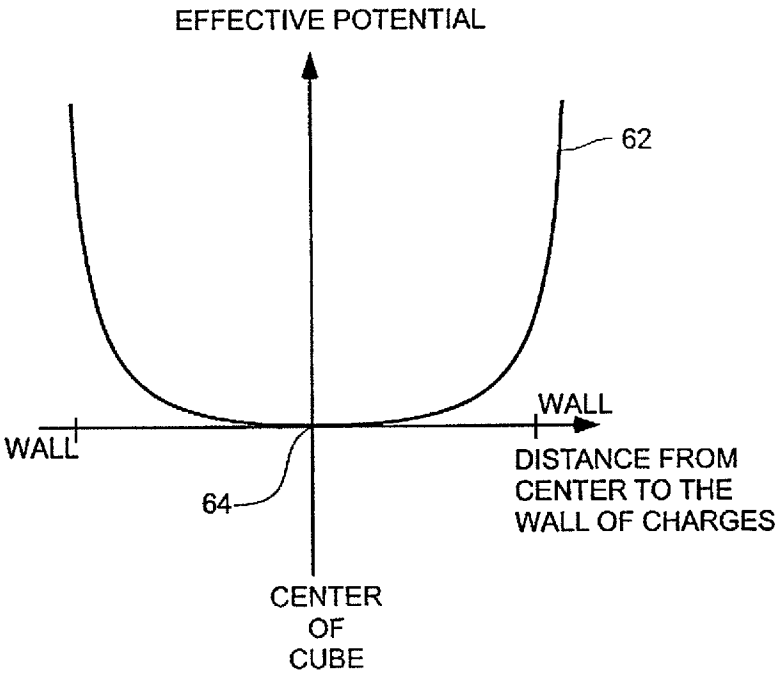
FIG. 2 is a graphical representation of an effective potential between walls of an embodiment of an ion trap device of the present disclosure.

In the ion traps of the present disclosure, this same pattern of alternating RF signals is applied to adjacent electrodes formed on each surface of a regular polyhedral structure enclosing an ion containment region. In the case of the cube-shaped ion trap 50, for example, a total of 294 quadrupoles are formed, which surround the ion containment region 54. Referring to FIG. 2, by appropriate application of alternating RF phases, a steep potential barrier 62 can be formed at the surfaces of the cube with a shallow well 64 towards the center of the device that will effectively repel positive and negative ions towards the center of the device and trap ions inside the volume 54. In this way, a very large number of ions with a wide range of masses can be trapped in the device.

Figure 1C:
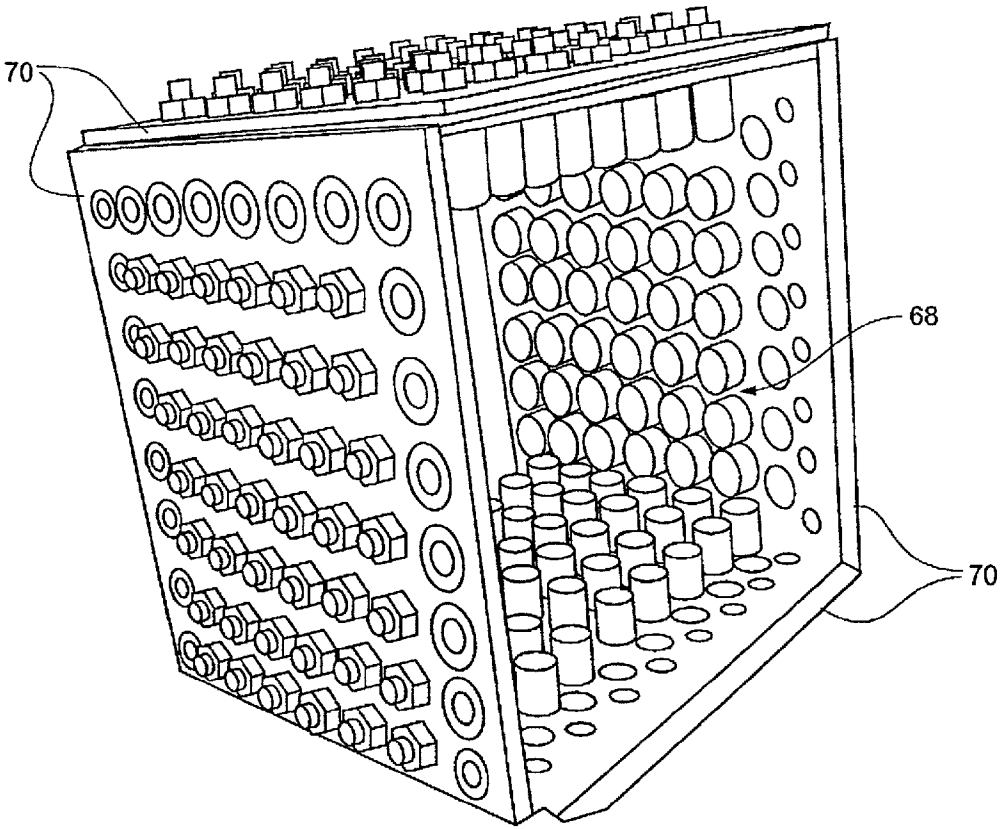
FIG. 1C is a perspective view of a partially assembled ion trap device of the present disclosure.

By further way of example, FIG. 1C shows a partially assembled ion trap device 66 with two of its surfaces removed, clearly showing a large hollow ion containment region 68. On each of the surfaces of the cube, a regular two-dimensional array of rod-shaped electrodes is positioned and oriented to provide an array of quadrupoles on each surface.

Referring again to FIG. 1A and FIG. 1C, an ion trap device of the present disclosure can also include plate electrodes 56 outside the surfaces 70 of the regular polyhedral structure of the device. Referring also to FIG. 1B, to prevent ions from escaping the ion containment region 60 along the axis of quadrupoles 65, where the RF field is small, a small DC potential can be applied to any number of the plate electrodes to repel the ions back towards the containment region 60.

In various embodiments, a DC voltage is applied in the range of between about 0 V and about +1000 V, preferably in the range of between about +0.02 V to about +100 V to at least a portion of the plate electrodes to prevent, for example, positive ions from escaping.

It should be noted that the embodiments described herein assume that positive ions are trapped for later analysis. One of skill in the art will recognize that negative ions produced by an ion source can likewise be generated and trapped in the containment region for analysis by, for example, a mass spectrometer. Accordingly, for negative ions, a DC voltage is applied in the range of between about 0 V and about −1000 V, preferably in the range of between about −0.02 V to about −100 V to prevent negative ions from escaping.

Referring, for example, to FIG. 1A, any of the plate electrodes 56 can include ports 58 to allow ions to be injected into the ion containment region 54, and/or for ejecting ions out of the ion containment region 54.

In one embodiment, to guide ions into the containment region 54, the two-dimensional array of rod-shaped electrodes on one of the surfaces of the cube can include a quadrupole ion guide 72 to guide ions into a containment volume and/or a quadrupole ion guide 74 to guide ions out of the containment volume. In the embodiment shown, the quadrupoles for ion guiding and mass filtering are formed from sets of extended rods. As will be appreciated by those of skill in the art, parameters such as the length of the extended rods, and the voltage and frequency of the RF signal applied to the rods of the quadrupole ion guides 72, 74 can be appropriately adjusted for ion guiding and/or for mass filtering for a particular mass-to-charge window. Accordingly, ions can be ejected in a mass-to-charge dependent manner through a port 58 in a plate electrode 56, for example, appropriately positioned to coincide with the region centered along the axis of the quadrupole 74.

In particular, by applying an RF voltage with a characteristic frequency corresponding to a particular ion mass range, mass selective ion ejection can be achieved along the axis of the quadrupole 74.

In various embodiments, the ion device can include a large number of quadrupoles. As shown in FIG. 1A, in one embodiment, an extended rod set of quadrupoles 76 can be provided and used for parallel analysis of the mass-to-charge values of a large range of ions stored in the trap. By appropriate application of different characteristic frequencies corresponding to different mass-to-charge windows, mass selective ion ejection from the device can be performed periodically or continuously along any or all of the $N^3-(N-2)^3-2$ quadrupole axes.

Accordingly, a parallel mass spectrometer of the present disclosure can include up to $N^3-(N-2)^3-2$ individual mass analyzers, one for each mass-to-charge window of ions ejected from each quadrupole for simultaneous parallel analysis of the ions stored in the device. Highly efficient parallel mass spectrometry free of losses associated with conventional sequential ion scanning can therefore be provided by implementing the ion device of the present disclosure.

While the electrodes shown in FIGS. 1A and 1C are cylindrical rods, any appropriately shaped electrode is contemplated to be within the scope of the present invention.

Figure 3C:
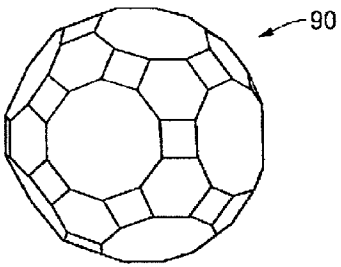
FIGS. 3A-3C are schematic representations of perspective views of additional embodiments of an ion trap device of the present disclosure of higher-order regular polyhedral structures.
Figure 3A:
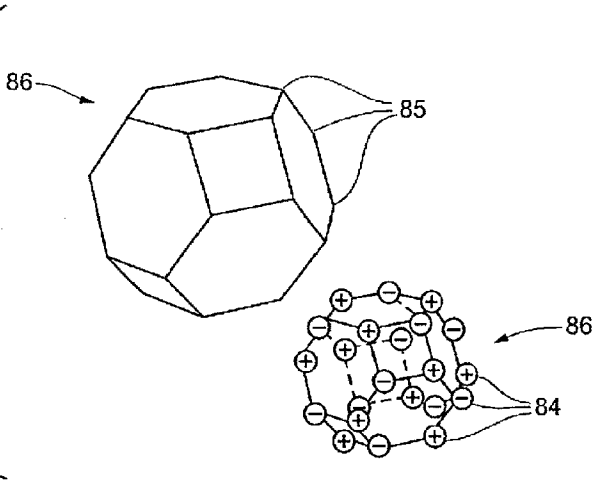
Figure 3B:
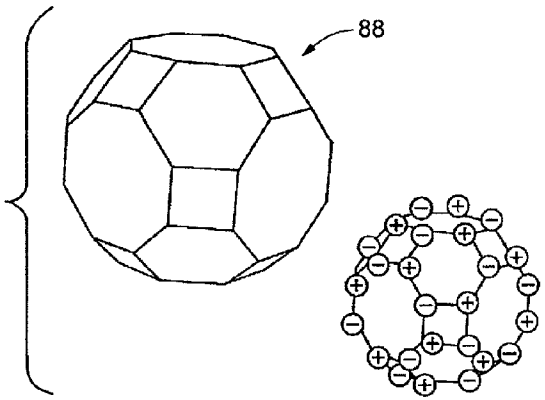
Figure 3D:
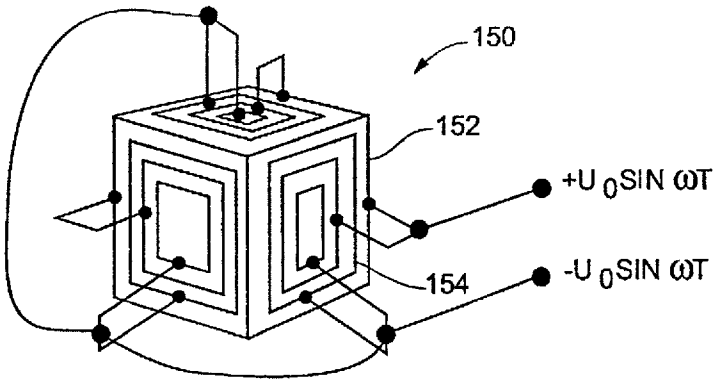
FIGS. 3D and 3E are schematic representations of perspective views of additional embodiments of an ion trap device of the present disclosure.
Figure 3E:
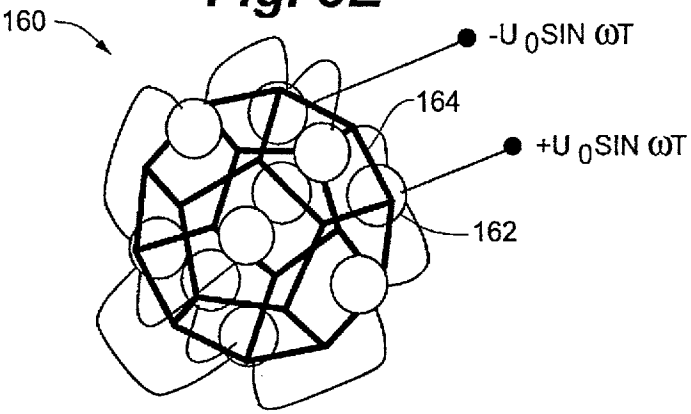

In various embodiments, the electrodes can be spherical, cylindrical, cubic, hyperbolic or various shaped annuli, as shown in FIGS. 3D and 3E (circular, triangular, square, and so on).

In additional embodiments, the electrodes can have a diameter between about 1 mm and 20 mm, preferably between about 5 mm and 10 mm.

In still other embodiments, a center-to-center distance between the electrodes aligned on a surface of the polyhedral structure can be between about 1.25 D and about 1.75 D, where D is a diameter of the electrodes aligned on the surface.

In yet other or additional embodiments, the center-to-center distance can be about 1.2 D to 1.5 D.

Particular embodiments of a surface structure encompassing the ion containment region have been discovered to be surprisingly high efficiency ion traps. While the surface structure of the present disclosure can be generally described as a regular polyhedral structure, having alternating RF-phased electrodes positioned at least at the vertices, it was found that superior results can be achieved with cube structures including both electrodes positioned at the vertices and additional electrodes positioned at regular intervals between the vertices. Preferred structures also include higher-order regular polyhedral structures.

For example, referring to FIGS. 3A-3E, a multi-pole ion trap of the present disclosure can include a plurality of electrodes positioned around an ion confinement region in a regular pattern provided by higher-order regular polyhedrons. While a cube is one of the simplest forms of a regular, or uniform, polyhedral structure, on which the plurality of electrodes are positioned, other forms are also contemplated. For example, electrodes 84 can be positioned at the vertices 85 of a tetrahedral structure 86, and an RF voltage applied with alternating polarity as shown. In other embodiments, additional electrodes could also be positioned in two-dimensional arrays on any one or more of the surfaces of the structure 86.

Referring to FIG. 3B, an octahedral structure 88 is another embodiment of a polyhedral structure suitable for enclosing an ion containment region of an ion trap of the present disclosure. By placing 24 electrodes at each vertex of the (4,6, 6)-octahedron 88 and applying RF voltage with alternating polarity to adjacent electrodes, six (6) quadrupoles and eight (8) hexapoles are formed on the surfaces encompassing the ion containment region.

In other embodiments, higher-order regular polyhedrons such as icosahedral structures 90 are contemplated to be within the scope of the invention. Preferably, suitable higher order 3D multi-poles will include an even number of electrodes on each side of the polyhedral structure.

Referring to FIG. 3D, an embodiment of a 3D multi-pole 150 can be also constructed by using the edges and the sides (faces) of a polyhedron by placing alternating annular electrodes 152, 154 outlining the shape of each of the polyhedron faces, and arranged in a nested pattern. For a cube, for example, in one embodiment, square annular electrodes of diminishing size are placed on all 6 sides of the cube, and an alternating potential as shown is applied to the alternating pairs. This approach can be extended to any regular polyhedron.

Referring to FIG. 3E, yet another embodiment of a 3D multi-pole 160 can be constructed from a plurality of electrodes including multiple electrodes outlining the edges 164 of a polyhedron, with additional electrodes 162 of opposite polarity as the outlined edges 164 on its faces. In the embodiment shown in FIG. 3E, a dodecahedron shaped 3D multipole is built by applying alternating RF potentials of opposite polarity to the electrode edges 164 ($-U_0 \sin \omega t$) and to spherical electrodes 162 ($+U_0 \sin \omega t$) positioned on the centers of the 12 dodecahydron faces.

Figure 4:
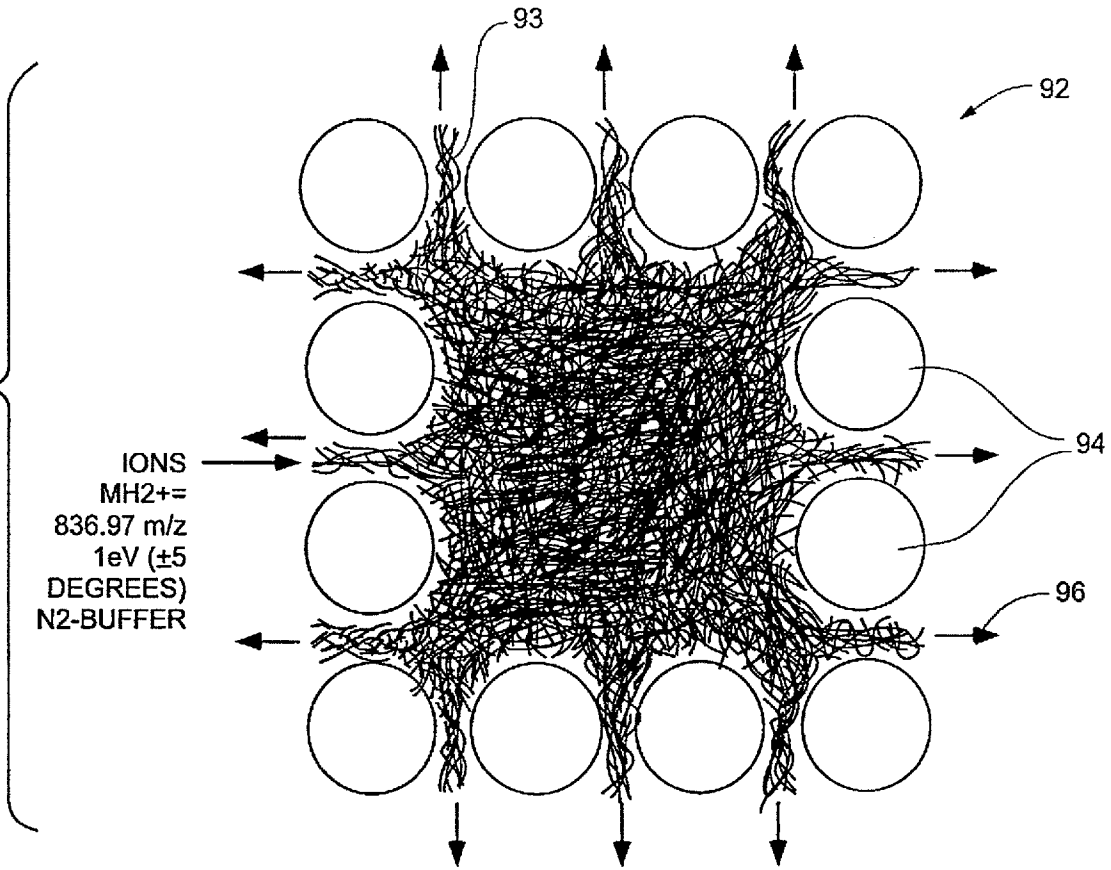
FIG. 4 is a schematic representation of simulations of ion trajectories associated with an embodiment of an ion trap device of the present disclosure.

Referring now to FIG. 4, simulations were conducted for ions stored inside another ion trap device 92 of the present disclosure, having a cubic structure, built from 56 spheres (N=4), by applying appropriate RF voltages to the quadrupoles formed from the electrodes. The ion trajectories 93 of 100 ions of mass 1500 Da, and m/z=501.007 (z=3) are shown projected onto a cross-sectional plane going through the center of the ion containment region, for the case where no trapping voltage was applied to the surrounding plate electrodes. 20% of ions escaped through the quadrupole axes after 10 ms. It was shown that ions can be allowed or encouraged to escape along any or all of the 54 axes between the electrodes 94, and that ions with different m/z ranges can be selectively ejected along chosen axes 96. Accordingly, the potential for simultaneous analysis of up to 54 different m/z windows was demonstrated.

Additional simulations were performed to verify that ions could be substantially repelled after the same interval of 10 ms by applying an appropriate stopping or trapping voltage to the plate electrodes. In one case, as shown, a 10 V DC voltage resulted in no ions escaping after 10 ms.

The result demonstrated by FIG. 4 indicates that the ion devices of the present disclosure can be used as very efficient ion beam splitters. Furthermore, the more electrodes that are used to build the trap, the larger are the number of quadrupoles through which ions can escape. One important consequence of this result is that if each quadrupole is configured to selectively transmit or eject a narrow m/z window, then m/z analysis can be performed in parallel. For example, a 17×17×17 ion trap device (built from $17^3$-$15^3$ or 1538 electrodes) can provide parallel analysis for mass spectrometry of all ions stored in the ion trap in a m/z range of about 1500 (the range currently used for ESI mass spectrometry) with 1 m/z wide windows. This provides an instrument that is potentially 1000-fold more efficient than current commercial mass spectrometers that sequentially select narrow m/z windows while rejecting, and, therefore, wasting, the rest of the ions during the analysis.

In addition, it was shown that ions can be prevented from escaping along the quadrupole axes by applying an appropriate DC potential to the plate electrodes 56 encompassing the trap. Under these conditions, ions can be stored in the trap for a long time, during which time they occupy essentially the entire inside ion containment volume. Extrapolating the experimental results of a simulated ion trap in which $10^7$ ions were stored in ~300 $mm^3$, an ion trap device of the present disclosure of dimensions 100 mm×100 mm×100 mm is expected to have a capacity of ~$3\times10^{10}$ ions.

An ion trap device formed in accordance with the present disclosure can also be used as an efficient device for real-time enrichment of multiply charged ions, by creating conditions for very efficient selective depletion of singly-charged ions.

The selective depletion of singly-charged ions is especially important in systems using MALDI and ESI sources. In both cases, the chemical noise mass spectra are heavily dominated by singly-charged ions. It is thus often desirable to remove these single charged species from the ion beam so as to effectively enrich the multiply-charged ion component—the major carriers of information in many proteomic experiments. Indeed, in analyses carried out on commercial Orbitrap-ion trap combinations, it is common to filter out the single charged ions after the high resolution Orbitrap scan to allow the ion trap to spend maximal time obtaining MS/MS spectra on the more information-filled multiply charged species. However, it is better in principle to filter these singly charged ions from the ion beam itself rather than after the fact for two reasons. First, such filtering increases the signal-to-noise, and, second, reduction of this unwanted ion signal should increase the effective ion capacity of the ion trap for the analytically useful multiply charged ion species.

It has been shown that by reducing the stopping potential applied, for example, to end-cap electrodes in a linear quadrupole, the potential barrier can be sufficiently reduced to allow singly charged ions to escape preferentially over multiply-charged ions.

As described in the Example section, in simulations of embodiments of the present ion trap device, selective depletion of singly charged ions has been surprisingly shown to be amplified with superior efficiency over that achieved in known ion traps, resulting in a highly efficient device for real-time enrichment of multiply charged ions.

Figure 5:
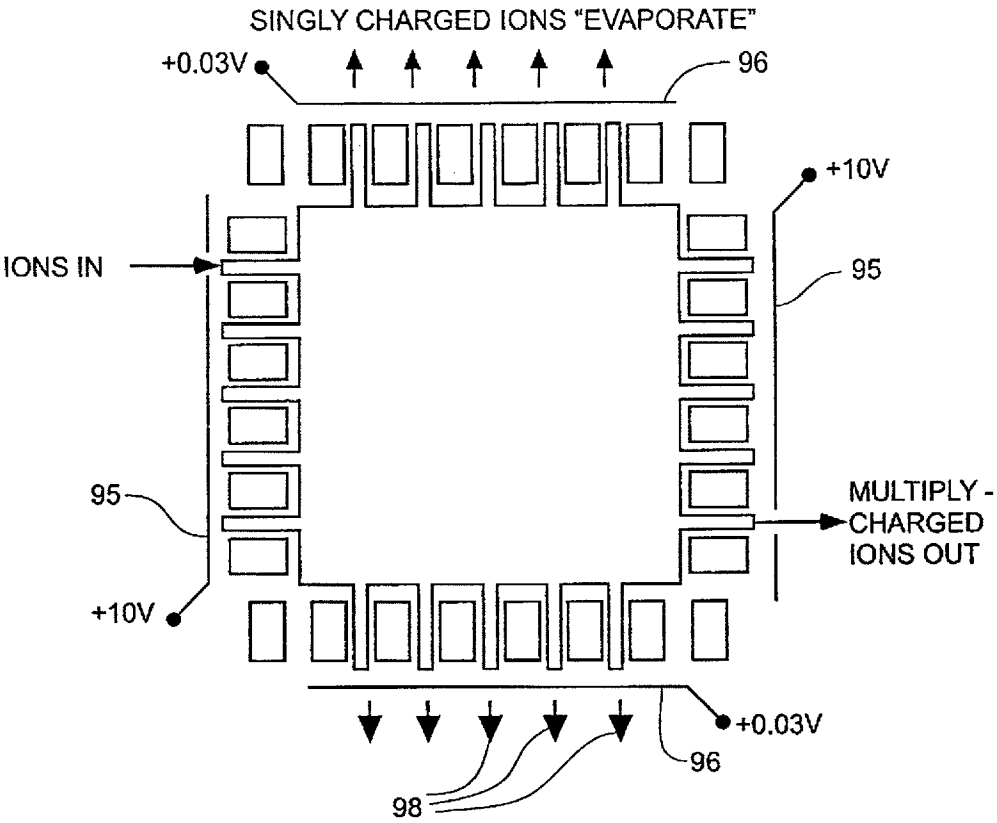
FIG. 5 is a schematic representation of a cross-sectional view of an embodiment of an ion trap device of the present disclosure.

Referring to FIG. 5, an embodiment of a cubic ion trap having 296 rod electrodes is shown, which includes at least two plate electrodes 95 maintained at a DC potential (e.g., +10V) sufficient to contain ions in the ion containment volume. If the same potential is applied to each of the plates, ions can be contained in the trap for a long period of time, for example, on the order of seconds to minutes. However, if the DC trapping voltage is reduced on one or more of the plate electrodes 96 to a sufficiently small value, e.g., ~+0.03V, singly charged ions will escape through this small potential barrier, but not multiply-charged ions. Because of the large number of escape channels ($N^3-(N-2)^3-2$ quadrupoles), the singly-charged ions will quickly "evaporate" from the trap providing an opportunity for real time enrichment of the multiply-charged ions that enter and leave the trap. The rate of singly charged ions evaporation can be amplified by increasing the number of plates maintained at the small stopping potential, and by increasing the number of channels 98.

Such a device in which a simple setting of a single voltage would efficiently remove all singly charged ions from the ion beam has the potential to become a potent tool for improving the signal-to-noise of MS analyses and for the highly desired discriminating reduction of the number of ions in the beam without throwing out information.

A mass spectrometry system of the present disclosure includes an embodiment of the ion trap. In one embodiment of the ion trap described herein, the multiple quadrupoles of the ion trap can be used as mass filters, each having a different m/z window for conditioning the ion beam for analysis. Accordingly, in one embodiment, a parallel mass spectrometer is provided which includes an ion trap device of the present disclosure for performing parallel analysis of all ions in the enclosure (cube).

In various additional embodiments, the ion trap is adapted to selectively enrich multiply-charged ions in real-time through depletion of singly-charged ions as they pass through the ion trap. By reducing the noise at the ion storage/filtering/fragmentation stage of the analysis, the overall signal-to-noise of the MS analysis is advantageously increased.

Figure 6:
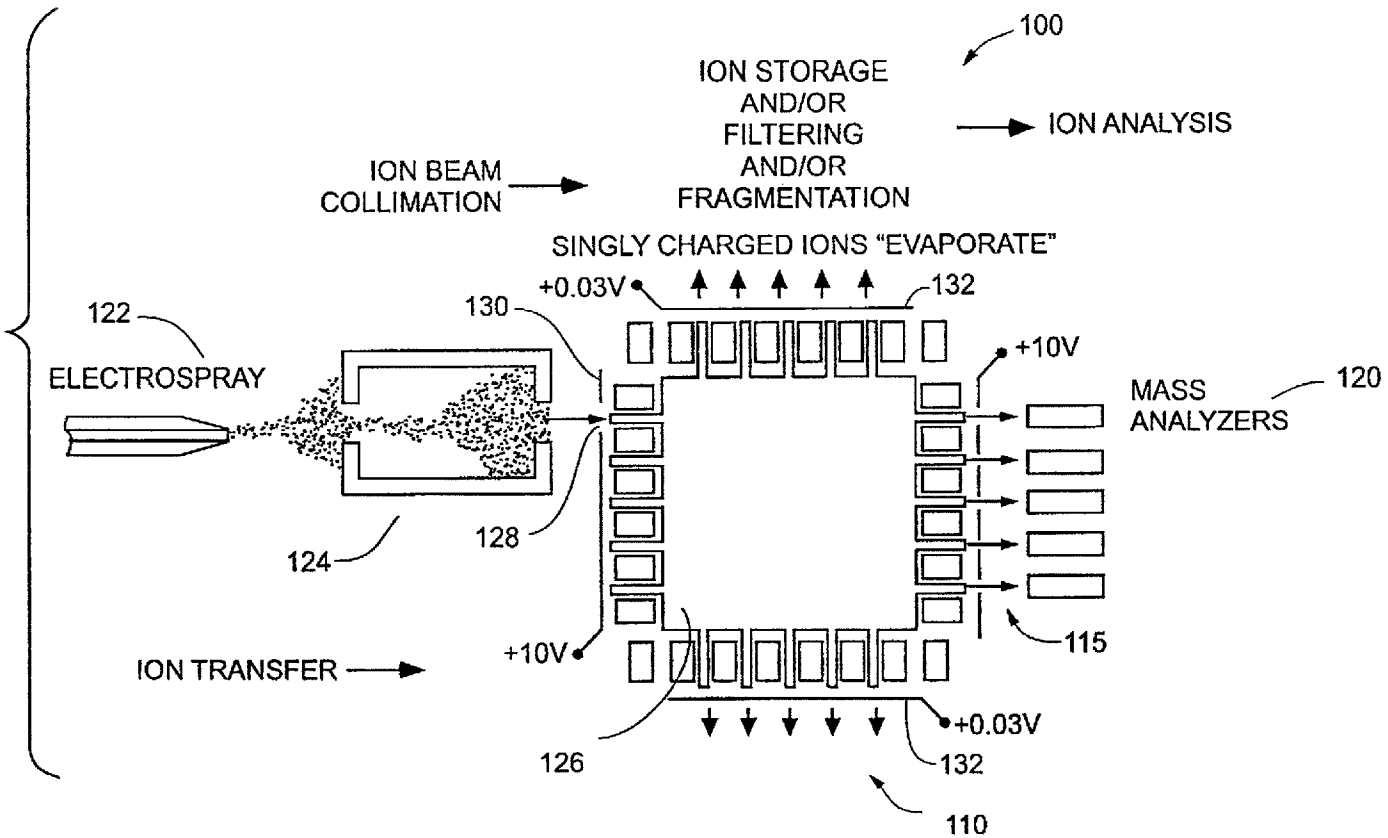
FIG. 6 is a schematic representation of a cross-sectional view of an embodiment of a mass spectrometer including an ion trap device of the present disclosure.

Referring to FIG. 6, a parallel mass spectrometer 100 includes an embodiment of an ion trap 110 in accordance with the present disclosure, with multiple parallel outputs 115 of ions in multiple m/z windows. The mass spectrometer can include a plurality of mass analyzers 120 for parallel mass analysis, with each mass analyzer coupled to a different output port 115. The ion trap 110, which in this particular embodiment includes 296 cylindrical rod electrodes, can be coupled to any appropriate ion source 122, such as an electrospray ionization source (ESI), or an appropriate Matrix-Assisted Laser Desorption-Ionization (MALDI) source. The mass spectrometer 100 can also include other elements known in the art such as a collimation device 124 for coupling ions from the ion source 122 into the ion trap 110. In the embodiment shown in FIG. 5, ions are coupled into an ion containment region 126 through a port 128 in one 130 of the six electrode plates that surround the cubic ion structure encompassing the containment region 126. In other embodiments, additional input ports can be provided to couple to additional ion or other sources.

The plate electrode 130 is preferably biased with a high DC voltage (e.g., about +10V) for containment of the injected ions in the containment region 126. Additional plates 132 can be biased at a small DC voltage, e.g., about +0.03V, for depletion of singly-charged ions. As discussed herein below, depletion of these singly-charged ions provides a mass spectrometer characterized by a high signal-to-noise ratio.

Mass selective ion ejection from embodiments of the ion trap device with multiple mass filtered outputs, such as the device 110, can be performed periodically or continuously along any or all of the $N^3-(N-2)^3-2$ quadrupole axes. The mass selective ion ejection, or filtering, can be performed according to methods known in the art, such as by mass resonance ion ejection, or using resonance ion injection into each quadrupole axis(channel) by supplying wide band resonance excitation containing all frequencies that excite all ions in the trap except the ions characterized by a particular m/z. These ions pass through the quadrupole to be detected at the exit using multiple ion detectors, or using a large array detector, such as a CCD, or in the case of analysis of chemical and biological assays, a "soft-landed" species device.

As should be apparent, the ion trap device of the present disclosure is extremely versatile. For example, a collision cell includes an ion trap device of the present disclosure. The ion containment region of the collision cell includes an appropriate buffer gas and mass filters are formed from quadrupoles on the surface of the polyhedral structure to accelerated ions from a narrow m/z window into the containment region.

In other embodiments, the ion trap device of the present disclosure is configured as an ion-ion, molecule-ion or photon-ion reactor.

EXAMPLE

The effect of selective depletion of singly charged ions was simulated for a multi-quadrupole ion trap of the present disclosure, as described in reference to FIG. 5, for example, built from 296 quadrupoles. The simulated results showed that 60 ions out of the originally trapped 100 ions having MW=500 and a single charge z=1 (m/z 501.007) were lost after 100 ms trapping in the containment region, by simulating a stopping voltage of about 0.03 V and an RF of about 5V.

By comparison, for the same structure and conditions, 25 ions out of 100 ions with MW=2500 and a charge z=5 (same m/z 501.007) were lost after 100 ms trapping in the containment region. The results of this simulation confirm that the singly charged ions are depleted from the trap a least two times faster than the 5+ charged ions. We expect that in reality, the effect will be much larger.

It should be apparent to those skilled in the art that the described embodiments of the present invention provided herein are illustrative only and not limiting, having been presented by way of example only. As described herein, all features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto.

What is claimed is:

1. An ion trap device, comprising:

a containment region for containing ions;

a plurality of electrodes encompassing the containment region, wherein the plurality of electrodes are arranged in a regular pattern on a surface of a structure enclosing the containment region, and wherein the containment region for containing ions corresponds substantially to a volume encompassed by the structure;

a plurality of quadrupoles, each quadrupole formed from a set of four of the electrodes positioned on the surface of the structure; and alternating electrodes of the plurality of electrodes configured for application of a first RF voltage, and electrodes interspersed between the alternating electrodes configured for application of a second RF voltage, the first and second RF voltage being of equal amplitude and opposite polarity at a point in time, neighboring electrodes of the plurality of electrodes being maintained at opposite phases, the plurality of electrodes configured to form a potential barrier for repelling the ions in the containment region from the surface of the structure; and wherein each of the plurality of quadrupoles is configured as a mass filter for selective ejection of the ions from or injection into the containment region in a predetermined ion mass-to-charge window, a frequency of the first RF and the second RF voltage applied to the electrodes in each of the plurality of quadrupoles corresponding to a characteristic frequency associated with the particular ion mass-to-charge window.

2. The ion trap device of claim 1, further comprising a plurality of plate electrodes, each plate electrode being positioned outside the surface, the plurality of plate electrodes comprising an input plate electrode and an output plate electrode, the input plate electrode comprising an input port for injecting ions into the containment region, the output plate electrode comprising an exit port for ejecting ions from the containment region, and wherein a first DC stopping voltage applied to the input plate electrode and to the output plate electrode contains the ions in the containment region.

3. The ion trap device of claim 1, wherein the regular polyhedral structure is cubic, and wherein the ion trap device includes a total of $N^3-(N-2)^3$ electrodes and $N^3-(N-2)^3-2$ quadrupoles, wherein N represents an integer greater than 2.

4. The ion trap device of claim 2, wherein one of the plurality of the plate electrodes is configured for application of a second DC stopping voltage that is lower than the first DC stopping voltage, the second DC stopping voltage generating a potential barrier sufficiently high to prevent depletion of multiple charged ions and sufficiently low to deplete singly charged ions from the containment region.

5. The ion trap device of claim 1, wherein each of the plurality of electrodes is a cylindrical rod.

6. The ion trap device of claim 1, wherein each of the plurality of electrodes is in the shape of a sphere.

7. The ion trap device of claim 1, wherein the structure is in one of a tetrahedral, octahedral and an icosahedral shape.

8. The ion trap device of claim 3, wherein a volume of the containment region is about 10 cm×10 cm×10 cm, the ion trap device having an ion capacity of greater than $10^{10}$ ions.

9. A parallel mass spectrometer comprising the ion trap device of claim 1, the parallel mass spectrometer comprising a plurality of mass analyzers coupled to the plurality of quadrupoles for parallel analysis of the ions in each ion mass-to-charge window.

10. The ion trap device of claim 1, wherein the plurality of quadrupoles includes at least one quadrupole extending in length outward from the first surface, the at least one quadrupole configured to guide ions into or out of the containment region.

11. A collision cell comprising the ion trap device of claim 10, the at least one quadrupole being configured to guide ions into the containment region in a particular mass-to-charge window, wherein the containment region further comprises a buffer gas, the ion trap device further comprising a second quadrupole extending in length outward from one of the plurality of regular polygonal surfaces, the second quadrupole configured to eject fragmented ions out of the containment region.

12. The ion trap device of claim 1, configured for use as one of an ion-ion, a molecule-ion, and a photon-ion reactor.

13. An ion trap device, comprising:

a containment region for containing ions;

a regular polyhedral structure comprising a plurality of regular polygonal surfaces encompassing the containment region, wherein the containment region for containing ions corresponds substantially to a volume encompassed by the regular polyhedral structure;

wherein each of the plurality of regular polygonal surfaces comprises at least two annular electrodes arranged in a nested pattern; and wherein alternating electrodes of the at least two annular electrodes configured for applying a first Rf voltage, and electrodes interspersed between the alternating electrodes configured for applying a second RF voltage, the first and second RF voltage being of equal amplitude and opposite polarity at a point in time, neighboring electrodes of the at least two annular electrodes being maintained at opposite phases, the at least two annular electrodes configured to form a potential barrier for repelling the ions in the containment region from each of the plurality of regular polygonal surfaces forming the regular polyhedral structure.

14. The ion trap device of claim 13, wherein the regular polyhedral structure is cubic.

15. A parallel mass spectrometer, the parallel mass spectrometer comprising: an ion source generating ions, a plurality of mass analyzers, and an ion trap device coupled to receive ions exiting the ion source and to eject ions to the plurality of mass analyzers in a mass-charge dependent manner, the ion trap further comprising:

a containment region for containing the ions received from the ion source;

a plurality of electrodes encompassing the containment region, wherein the plurality of electrodes are arranged in a regular pattern on a surface of a structure enclosing the containment region, and wherein the containment region for containing the ions corresponds substantially to a volume encompassed by the structure;

a plurality of quadrupoles, each quadrupole formed from a set of the electrodes positioned on the surface of the structure and alternating electrodes of the plurality of electrodes configured for application of a first RF voltage, and electrodes interspersed between the alternating electrodes configured for application of a second RF voltage, the first and second RF voltage being of equal amplitude and opposite polarity at a point in time, neighboring electrodes of the plurality of electrodes being maintained at opposite phases, the plurality of electrodes configured to form a potential barrier for repelling the ions in the containment region from the surface of the structure; and wherein each of the plurality of quadrupoles is configured as a mass filter for selective ejection of the ions from the containment region in a predetermined ion mass-to-charge window, a frequency of the first RF and the second RF voltage applied to the electrodes in each of the plurality of quadrupoles corresponding to a characteristic frequency associated with the predetermined ion mass-to-charge window, each of the plurality of quadrupoles being coupled to a different one of the plurality of mass analyzers for parallel analysis.

16. The parallel mass spectrometer of claim 15, wherein a plurality of vertices and a plurality of regular polygonal surfaces define the regular polyhedral structure, further comprising a plurality of plate electrodes, each plate electrode being positioned outside a corresponding one of the plurality of regular polygonal surfaces, the plurality of plate electrodes comprising an input plate electrode and an output plate electrode, the input plate electrode comprising an input port for injecting ions into the containment region, the output plate electrode comprising an exit port for ejecting ions from the containment region, and wherein a first DC stopping voltage applied to the input plate electrode and to the output plate electrode to contains the ions in the containment region.

17. The parallel mass spectrometer of claim 16, wherein the plurality of electrodes further includes an additional set of electrodes configured to form a plurality of second quadrupoles on a second surface of the plurality of regular polygon surfaces, wherein one of the plurality of the plate electrodes is configured to apply a second DC stopping voltage that is lower than the first DC stopping voltage, the second DC stopping voltage generating a potential barrier sufficiently high to prevent depletion of multiple charged ions and sufficiently low to deplete singly charged ions along an axis associated with each of the plurality of second quadrupoles from the containment region.

* * * * *